United States Patent [19]

Suga

[11] 3,932,785

[45] Jan. 13, 1976

[54] CARBON ELECTRODE SUPPORT

[76] Inventor: Shigeru Suga, Yoyogi 5-20-2, Shibuya, Tokyo, Japan

[22] Filed: Aug. 26, 1974

[21] Appl. No.: 500,472

[52] U.S. Cl. ..... 314/130; 314/134; 314/51

[51] Int. Cl.[2] ..... H05B 31/18

[58] Field of Search ..... 314/7, 51, 101, 130, 134, 314/60; 13/14–17; 313/147, 278

[56] References Cited

UNITED STATES PATENTS

| | | | |
|---|---|---|---|
| 1,765,957 | 6/1930 | Westphalen | 314/101 |
| 2,002,549 | 5/1935 | Richardson | 314/7 |
| 3,046,437 | 7/1962 | Kuppens | 314/51 |
| 3,804,966 | 4/1974 | Winter et al. | 13/16 |

*Primary Examiner*—R. N. Envall, Jr.

*Attorney, Agent, or Firm*—Wenderoth, Lind & Ponack

[57] ABSTRACT

A support includes a support element having two electrode contact areas for each electrode to be clamped. Each contact area has fixed thereto a conductive carbon plate. A clamping device has a non-conductive clamping surface for clamping each electrode against its respective pair of carbon plates.

5 Claims, 3 Drawing Figures

CARBON ELECTRODE SUPPORT

BACKGROUND OF THE INVENTION

The present invention is directed to an improved holding device for clamping or supporting in position carbon electrodes of a carbon arc lamp, particularly of the type employed in weathering testers.

There are presently known weathering testers of the type formed by a carbon electrode arc discharge lamp. In this type of device, a plurality of carbon electrodes are mounted in a lower support, and an equal number plurality of electrodes are mounted in an upper support directly above the lower electrodes. A frame of the device allows the lower electrodes and upper electrodes to be moved toward and away from each other. When the device is connected to a source of power, there are discharges across adjacent electrodes of the upper and lower groups, thereby creating light, whereby material positioned around the device may be weather tested.

In the past, the holder or support devices for both the upper and lower groups of electrodes have consisted primarily of a metallic element such as a copper alloy or stainless steel element presenting contact surfaces with a metallic coating, such as a copper coating, on each carbon electrode. However, although copper alloys have good electrical conductivity, they are easily oxidized and corroded, thereby decreasing the efficiency of the device. Stainless steel has a large contact resistance. Also, most metals are good conductors of heat and thereby excess heat is produced in the support or holder element.

SUMMARY OF THE INVENTION

With the above discussion in mind, it is a primary object of the present invention to provide an improved support or holder device for grasping a plurality of carbon electrodes for use in an arc discharge lamp, particularly of the type employed in weathering testers.

In accordance with the present invention, the above object is achieved by the provision of a support device including a support element, normally of metal, having two contact areas for the contact with each carbon electrode to be supported. Each contact area is formed by a contact plate of conductive carbon which is fastened to the support element, thereby providing a contact surface with each electrode.

Each electrode to be supported or held is positioned against two of the carbon plates on the support element. This support element has a terminal for attachment to a source of electric power. A clamping unit is operable to contact at one surface of each carbon electrode and to clamp it against its two respective contact surfaces of the support element, thereby insuring that the support grasps or holds each electrode in place. The elements of the clamping device which contact the carbon electrodes are formed of a heat resistant non-conductive material, such as a ceramic material. Preferably, the holder of the present invention will hold four carbon electrodes, and the clamping device has two elements each having two contact surfaces, one each for contacting one carbon electrode.

BRIEF DESCRIPTION OF THE DRAWINGS

The invention will be described in more detail in the following description below, taken together with the accompanying drawings wherein.

DETAILED DESCRIPTION OF THE INVENTION

Figure 1:
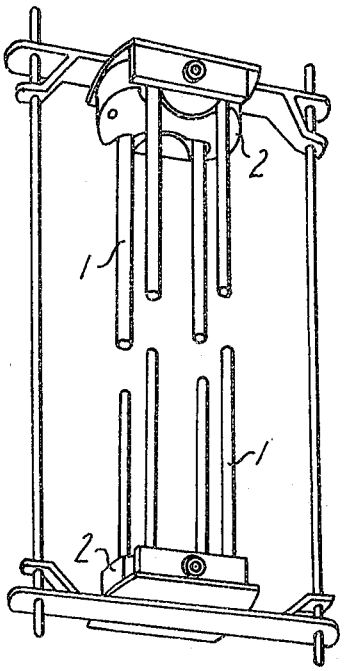
FIG. 1 is a perspective view of a carbon electrode arc discharge lamp, such as employed for weathering testers.

With reference to FIG. 1 there is shown a weather tester which is formed by a carbon electrode arc discharge lamp. Specifically, four upper carbon electrodes 1 are held in an upper support 2, and four lower carbon electrodes 1 are held in a lower support 2. The two supports are held together in a frame which is operable by suitable means not shown to move the upper and lower carbon electrodes toward and away from each other. When the device is connected to a source of electric power, an arc discharge will occur across adjacent electrodes of the upper and lower groups, thereby creating light. Material to be weather tested is positioned around the device. It is of course to be understood that although in the present invention each of the upper and lower groups of electrodes includes four carbon electrodes, the present invention is not intended to be specifically limited to this number.

Figure 2:
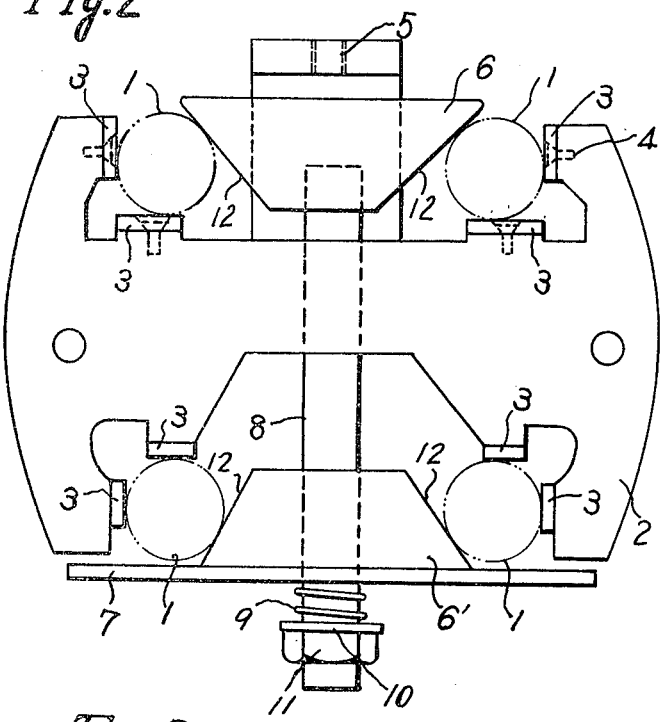
FIG. 2 is a plan view of the electrode holding device of the present invention.
Figure 3:
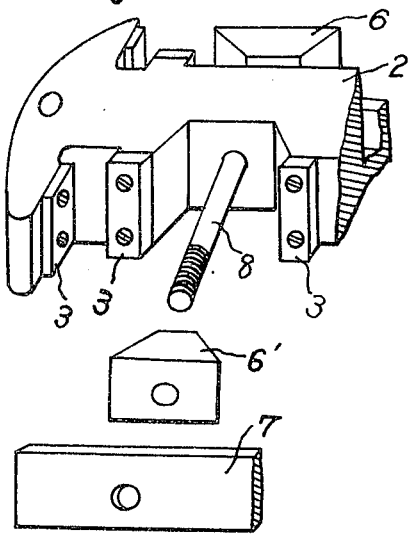
FIG. 3 is an exploded perspective view with portions broken away of the support device of the present invention.

With reference to FIGS. 2 and 3 of the drawings, the novel electrode support device will now be described. The support device includes a support element 2 of any suitable material, but normally of metal. Support element 2 is formed in a suitable shape, such as the generally H-shape shown in FIG. 2, to provide two electrode contact areas for each electrode to be supported thereby. As shown in FIG. 2 of the drawings, the specifically illustrated support element has two cut-out areas to provide two support areas for each electrode, the support areas of each electrode being generally at right angles to each other. It should be understood that this specific configuration is not intended to be limiting to the present invention. Rather, the present invention is intended to provide any suitable configuration of support element 2 wherein there are provided two support areas for each electrode to be held thereby.

At each electrode contact area there is attached by suitable means such as counter-sunk screws 4 a contact plate 3 formed of conductive plate shaped carbon. Each carbon plate 3 provides an outer contact surface for contact with an electrode 1. Thus, a plurality of pairs of carbon plates 3 provide a plurality of pairs of contacts with a plurality of electrodes, in the illustrated embodiment such plurality being four.

Support element 2 has integral therewith an element providing suitable attachment means such as opening 5 for attachment to a terminal to be connected to a source of electric power.

It will be apparent from a review of FIG. 2 that each pair of carbon plates 3 are not alone sufficient to hold an electrode 1 in place. Therefore, the present invention further includes a clamping element which provides a third contact surface for each carbon electrode to clamp such carbon electrode against its two contact surfaces formed by each pair of carbon plates 3.

In accordance with the present invention, the elements of the clamping device which form the third contact surface are formed of a heat resistant non-conductive material. In a particularly preferable embodiment of the present invention, such elements are formed of a ceramic material.

As shown in FIG. 2, the clamping device includes two carbon electrode contacting elements 6 and 6′. In the embodiment illustrated, these elements are formed generally as truncated prisms having surfaces 12 which are oblique to the contact surfaces of carbon plates 3. One clamping body 6 has a shaft or rod 8 fastened thereto, the shaft 8 passing through support element 2 and the other clamping element 6′. Suitable biasing means such as nut 11, washer 10, spring 9, and plate 7 urge the two clamping elements 6 and 6′ toward each other, and thereby toward carbon electrodes 1 which are positioned against their respective pairs of carbon contact plates 3. It will be apparent from a review of FIG. 2 of the drawings that this structural arrangement results in a clamping of each carbon electrode 1 by three contact surfaces, two of which are conductive, and one of which is non-conductive.

It will be readily apparent that the provision of the present invention prevents the flow of current through the elements of the clamping device, thereby insuring a more efficient current flow. It will be further apparent that in view of the fact that the conductive contact surfaces between each electrode and the support element are formed of carbon, there will be achieved good electrical conductivity without previously known dangers of oxidation and resultant corrosion of the contact surfaces. It will be still further apparent that at such time as carbon plates 3 become worn, they may be readily and easily replaced by the simple removal of counter-sunk screws 4.

It will be understood to those skilled in the art that various modifications of the specific configuration illustrated can be made without departing from the spirit and scope of the present invention.

What is claimed is:

1. A holding device for clamping at least a plurality of carbon electrodes, particularly for use in a carbon arc lamp, said holding device comprising:

a support element having two support areas for each electrode to be clamped;

each said pair of support areas having fixed thereto a pair of conducting means for forming a pair of contact surfaces for contacting an electrode; and clamping device means, having a third non-conductive contacting surface for each electrode to be clamped, for clamping each electrode against its respective pair of conducting means, said clamping device means comprising a first clamping body having thereon plural non-conductive contacting surfaces, a second clamping body having thereon plural non-conductive contacting surfaces, and means for biasing said first and second clamping bodies toward each other.

2. A holding device as claimed in claim 1, wherein each of said conducting means comprises a carbon plate.

3. A holding device as claimed in claim 1, wherein each of said conducting means of each of said pair of conducting means provide said contact surfaces thereof at right angles to each other.

4. A holding device as claimed in claim 1, wherein said third non-conductive contacting surface is formed of ceramic material.

5. A holding device as claimed in claim 1, wherein said holding device clamps four electrodes; and wherein said first clamping body has thereon two non-conductive contacting surfaces, and said second clamping body has thereon two non-conductive contacting surfaces.

* * * * *